US008641040B2

(12) United States Patent
Cahill et al.

(10) Patent No.: US 8,641,040 B2
(45) Date of Patent: Feb. 4, 2014

(54) KIOSK-INSTALLABLE PRINTER WITH DUPLEX PATH UTILIZED TO DELIVER PRINTED MEDIA SHEETS TO LOWER FRONT EXTERIOR OF PRINTER

(75) Inventors: Daniel Paul Cahill, Verona, KY (US); Chad Michael Piening, Lexington, KY (US); Louann Behymer Samuels, Georgetown, KY (US); Brian Patrick Weaver, Shelbyville, KY (US); Curtis Duane Woodson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 985 days.

(21) Appl. No.: 12/189,518

(22) Filed: Aug. 11, 2008

(65) Prior Publication Data

US 2010/0032883 A1 Feb. 11, 2010

(51) Int. Cl.
*B65H 29/00* (2006.01)

(52) U.S. Cl.
USPC ..... 271/186; 271/291; 271/301; 271/303

(58) Field of Classification Search
USPC ..... 271/301–303, 291, 65, 186; 399/401, 399/405
See application file for complete search history.

(56) References Cited

U.S. PATENT DOCUMENTS 4,872,659 A * 10/1989 Kato et al. ..... 271/9.01
5,594,542 A * 1/1997 Sugimoto et al. ..... 399/402
5,996,995 A * 12/1999 Kim et al. ..... 271/303
6,267,368 B1 * 7/2001 Tomoe et al. ..... 271/9.09
7,292,820 B2 11/2007 Triplett et al.
2003/0116911 A1 * 6/2003 Kanai ..... 271/303
2005/0184442 A1 * 8/2005 Kitano ..... 271/4.03
2007/0065200 A1 * 3/2007 Asaba ..... 399/394
2007/0182086 A1 8/2007 Murrell et al.

FOREIGN PATENT DOCUMENTS

JP 63134435 A * 6/1988 ..... B65H 1/30
JP 03211161 A * 9/1991 ..... B65H 31/24

* cited by examiner

*Primary Examiner* — Prasad Gokhale

(74) *Attorney, Agent, or Firm* — Justin M Tromp; John Victor Pezdek

(57) ABSTRACT

An image forming device includes an image formation path extending from an entrance end adjacent to a source of supply of media sheets, past an image forming station, to an exit end adjacent to a top collection site adapted to receive media sheets, a duplex path extending from an inlet end adjacent the top collection site to an outlet end adjacent a lower front opening in the device, a media sheet directing mechanism disposed between the exit end of the image formation path, top collection site and inlet end of the duplex path and selectively operable to deliver printed media sheets to the top collection site or the inlet end of the duplex path, and a deflector mechanism between the lower front opening and the outlet end of the duplex path and operable to divert printed media sheets from the duplex path through the lower front opening to exterior of the device.

18 Claims, 4 Drawing Sheets

KIOSK-INSTALLABLE PRINTER WITH DUPLEX PATH UTILIZED TO DELIVER PRINTED MEDIA SHEETS TO LOWER FRONT EXTERIOR OF PRINTER

BACKGROUND

1. Field of the Invention

The present invention relates generally to the field of image forming devices and, more particularly, to a kiosk-installable printer having a lower exit path utilized to deliver printed media sheets to the lower front exterior of the printer.

2. Description of the Related Art

Some image forming devices, such as printers, utilize either C-shaped or S-shaped paper paths, such as seen in FIGS. 1 and 2, to deliver a printed media sheet to an output stack face down at a collection site located on the top of the printer. These paper path shapes are advantageous in that they allow the output stack to be collated. It can be readily observed that with either a C-shaped or S-shaped paper path, the printed media sheet is outputted within the printer footprint.

Representative printers having the C-shaped paper path are described in U.S. Pat. Appl. Pub. No. 2007/0182086 and U.S. Pat. No. 7,292,820 both assigned to the assignee of the present invention. The operations of these printers are conventionally well-known. In each printer, after a media sheet is introduced through either an input tray or a multi-purpose feeder, the media sheet is aligned and then fed to image forming stations downstream. The printers are capable of forming an image on one or both sides of the media sheet and delivering it to the top collection station of the printers. However, these printers are not capable of outputting the printed media sheet beyond the footprint of the printer so that it could be easily delivered out of a kiosk or other like enclosure to the general public.

Thus, there is a need for an innovation to overcome this shortcoming so that the market for these printers can be expanded by adapting them for use in kiosks and the like.

SUMMARY OF THE INVENTION

The present invention meets this need by providing an innovation that allows a printed media sheet to be delivered outside of the footprint of the C-shaped paper path printer after making only minimal modification to the printer. This innovation takes advantage of a pre-existing duplex path in the printer. The need thus satisfied by this minimal modification of the printer is the provision of the capability of outputting printer media sheets from the printer at a lower front exterior location thereon so that they can exit the cabinet of a kiosk enclosing the printer.

Accordingly, in an aspect of the present invention, an image forming device includes a housing having a collection site on an exterior top portion thereof adapted to receive printed media sheets and a lower front opening to exterior of the housing, an image formation path in the housing extending from an entrance end adjacent a source of supply of media sheets in the housing, past an image forming station in the housing, to an exit end adjacent to the collection site, a lower exit path in the housing extending from an inlet end adjacent to the collection site to an outlet end adjacent the entrance end of the image formation path and the lower front opening in the housing, a media sheet directing mechanism disposed in the housing between the exit end of the image formation path, the collection site, and the inlet end of the lower exit path and selectively operable to deliver printed media sheets to the collection site or the inlet end of the lower exit path, and a deflector mechanism in the housing between the lower front opening and the outlet end of the lower exit path and operable to divert printed media sheets from the lower exit path through the lower front opening to exterior of the housing.

In one exemplary embodiment of the present invention, the deflector mechanism includes a diverter body disposed in the housing between the outlet end of the lower exit path and the lower front opening in the housing. The diverter body has a main portion, disposed at a predetermined angle of slope relative to a horizontal plane, defining a discharge path extending downwardly and outwardly from the outlet end of the lower exit path to the lower front opening of the housing. The diverter body is mounted in a stationary position in the housing and, as an example, on a media input tray disposed in the housing below the entrance end of the image formation path and adapted to hold a stack of the media sheets so as to provide the source of supply of media sheets.

In another exemplary embodiment of the present invention, the deflector mechanism includes a diverter body movably disposed in the housing for undergoing movement between first and second orientations wherein the first orientation the diverter body deflects media sheets along a discharge path extending downwardly and outwardly from the outlet end of the lower exit path through the lower front opening to the exterior of the housing and wherein the second orientation the diverter body deflects media sheets to move along a return path extending from the outlet end of the lower exit path to the entrance end of the image formation path. The deflector mechanism also includes a prime mover disposed in the housing and drivingly coupled to the diverter body and being selectively operable to move the diverter body to change the diverter body between the first and second orientations thereof.

BRIEF DESCRIPTION OF THE DRAWINGS

Figure 1:
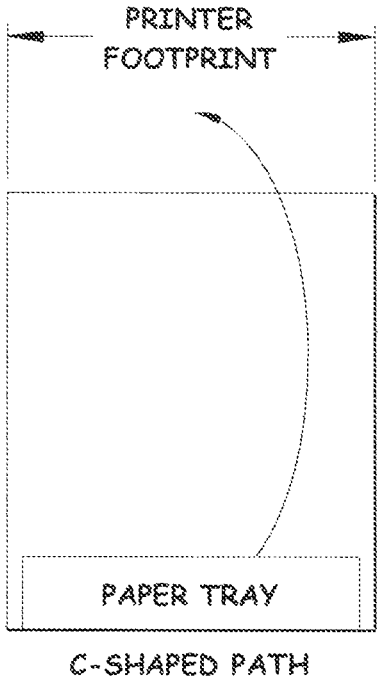

Having thus described the invention in general terms, reference will now be made to the accompanying drawings, which are not necessarily drawn to scale, and wherein:

FIG. 1 is a schematic representation of the footprint of a printer having a C-shaped paper path.

Figure 2:
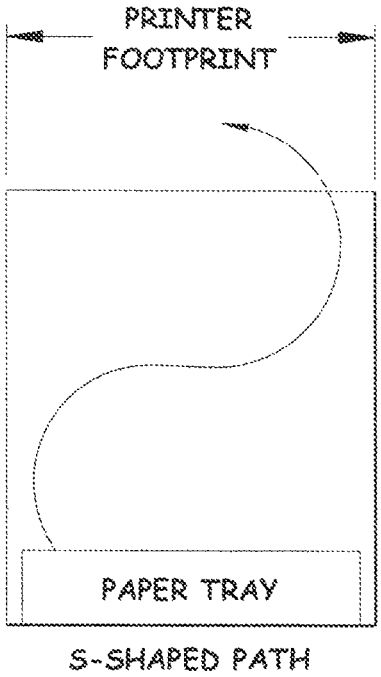

FIG. 2 is a schematic representation of the footprint of a printer having a S-paper path.

Figure 3:
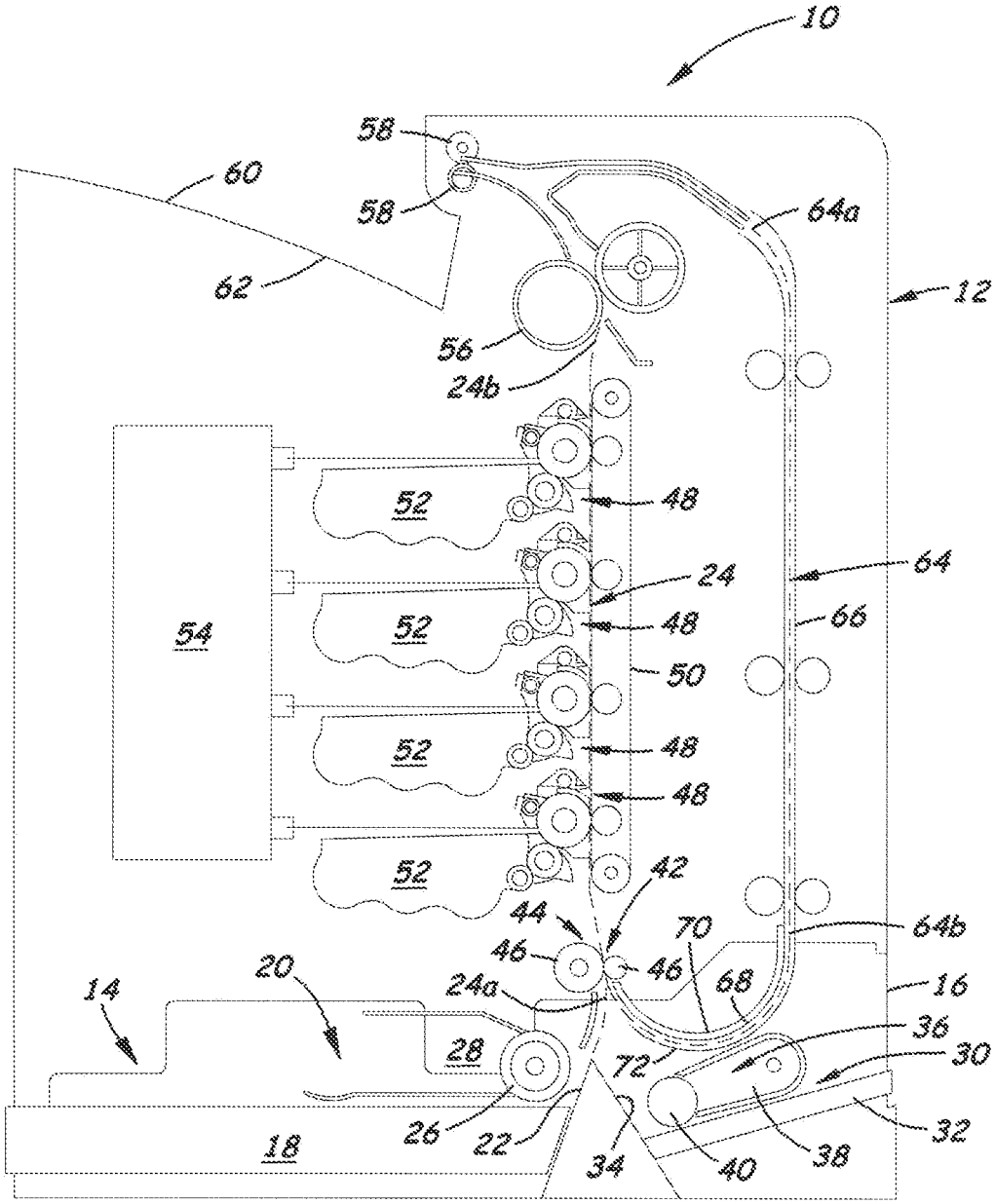
Fig. 3 (PRIOR ART)

FIG. 3 is a schematic representation of a prior art printer with respect to which modifications in accordance with the present invention can be applied.

Figure 4:
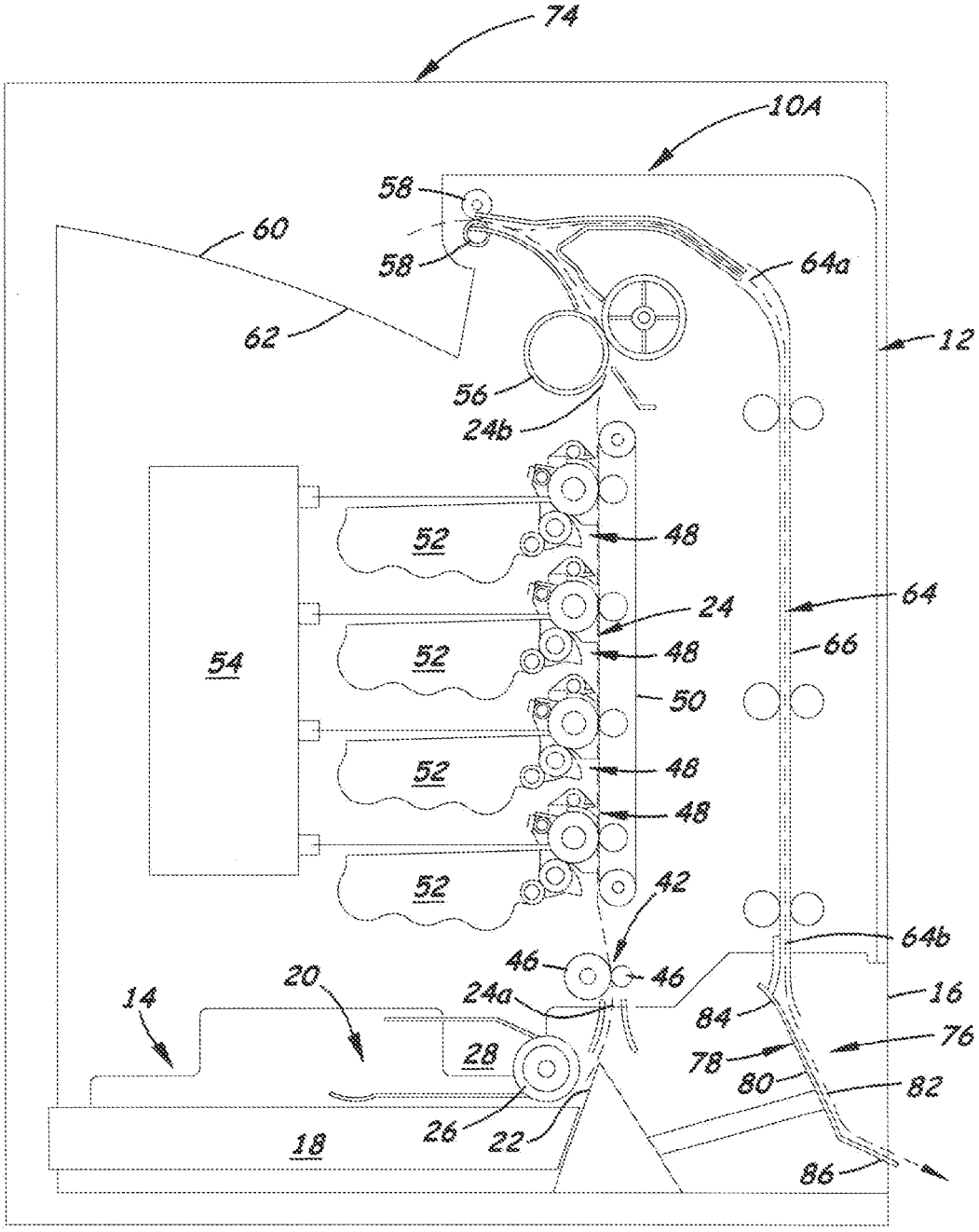

FIG. 4 is a schematic representation similar to that of FIG. 3 but showing the printer after one exemplary embodiment of a media sheet diverter mechanism has been implemented in accordance with the present invention thus adapting the printer for installation in a kiosk cabinet as shown in FIG. 4.

Figure 5:
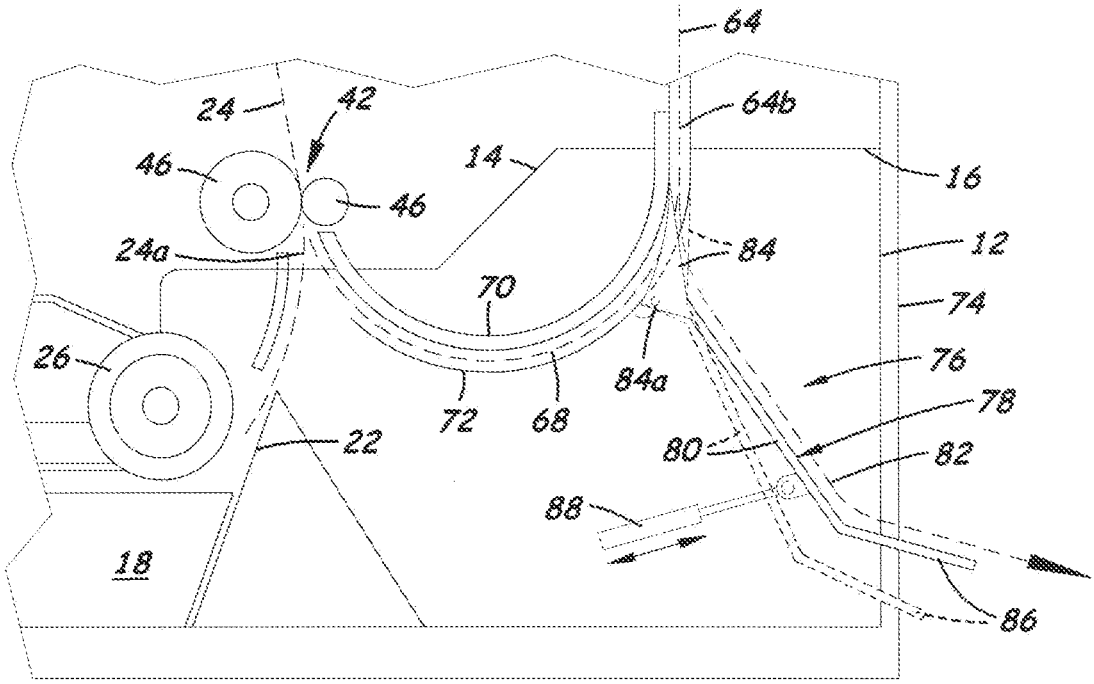

FIG. 5 is an enlarged schematic representation of the other exemplary embodiment of the media sheet diverter mechanism for accommodating printing on both sides of the media sheet.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, one or more embodiments are provided so that this disclosure will satisfy applicable legal requirements. Like numerals refer to like elements throughout the views. Also, terms such as "top", "lower", "front" and the like, are used herein as terms of convenience and not of limitation.

Referring now to FIG. 3, there is schematically represented a prior art printer, generally designated 10, having a C-shaped paper path. This printer is described in detail in either one of U.S. Pat. Pub. No. 2007/0182086 and U.S. Pat. No. 7,292,820 both assigned to the assignee of the present invention. Their disclosures are hereby incorporated by reference.

The printer 10 includes a housing 12 and a media input tray 14 removably disposed in the housing 12 through a lower front opening 16 in the housing 12 and providing a source of media sheets for the operations of the printer 10. The input tray 14 is sized to hold a first stack 18 of the media sheets. A sheet pick mechanism 20 also disposed in the housing 12 feeds or picks the media sheets from the tray 14 and along a ramp 22 that directs the sheets further along toward an entrance end 24*a* of an image formation path 24. The sheet pick mechanism 20 may include a roller 26 positioned on a pivoting arm 28. The pivoting arm 28 causes the roller 26 to remain in contact with a topmost sheet on the first stack 18. Rotation of the roller 26 removes the media sheet from the stack 18 with the leading edge contacting the ramp 22 so that the sheet will thus be moved toward the entrance end 24*a* of the image formation path 24.

A multi-purpose feeder 30 may also be included in the housing 12 of the printer 10 to move additional media sheets toward the entrance end 24*a* of the image formation path 24. The multi-purpose feeder 30 includes a support floor 32 adjacent to another ramp 34. An additional sheet pick mechanism 36 is provided, having a pivoting arm 38 and a roller 40 thereon. Rotation of the roller 40 moves the media sheet from the support floor 32 up the ramp 34 toward the entrance end 24*a* of the image formation path 24. The additional sheet pick mechanism 36 within the multi-purpose feeder 30 may be the same or different from the sheet pick mechanism 20 associated with the media input tray 14.

The operation of the printer 10 is conventionally well-known. After a media sheet is introduced through the input tray 14 or a multi-purpose feeder 30, the media sheet is presented at the entrance end 24*a* of the image formation path 24 as defined by a nip 42 of a media alignment mechanism 44 formed between its pair of rollers 46. The media alignment mechanism 44 removes lateral skew from the media sheet and precisely times its passage on to the image forming stations 48 located downstream along the image formation path 24.

After the media sheet passes the media alignment mechanism 44 it contacts a transport belt 50, which carries the media sheet along the image formation path 24 past successive photoconductor units 52 of the image forming stations 48. At each successive photoconductor unit 52, a latent image is formed by an imaging device 54 and optically projected onto a photoconductive member. The latent image is developed by applying toner to the photoconductive member from a toner reservoir. The toner is subsequently deposited on the media sheet as it is conveyed past each of the photoconductor units 52 by the transport belt 50.

The toner is then thermally fused to the media sheet by a fuser 56 and the sheet then passes through an exit end 24*b* of the image formation path 24 to a media sheet directing mechanism in the form of a pair of reversible exit rollers 58 which feed the media sheet face down onto a media sheets collection site 60 on a top exterior portion 62 of the printer housing 12. Alternatively, the exit rollers 58 may reverse motion after the trailing edge of the media sheet has passed an inlet end 64*a* to a lower exit path 64. The reversed exit rollers 58 then direct the media sheet through the inlet end 64*a* of the vertically-oriented lower exit path 64 to where the media sheet moves through an internal structure 66 defining the lower exit path 64 to an outlet end 64*b* of the lower exit path 64 from which the media sheet then travels through a return path 68 defined between a pair of upper and lower guides 70, 72 that interconnect the outlet end 64*b* of the lower exit path 64 with the nip 42 at the entrance end 24*a* of the image formation path. Then the media sheet is transported back through the image formation path 24 where it is processed for the printing of another image on the back side of the media sheet. The doubled-sided printed media sheet is then delivered face down to the collection site 60 on the printer housing 12.

The prior art printer 10 of FIG. 3 can be minimally modified or changed mechanically in accordance with the present invention to provide the modified printer 10A shown in FIG. 4 which now accommodates the outputting of printed media sheets from the lower exit path 64 of the printer 10 so that they can exit a kiosk cabinet 74 enclosing the modified printer 10A in FIG. 4. The components already described in the prior art printer 10 in FIG. 3 which are also present in the modified printer 10A in FIG. 4 are identified in FIG. 4 by the same reference numerals.

Turning now to FIG. 4, it can be readily seen that the modifications or changes embodied in the modified printer 10A are that the multi-purpose feeder 30 and additional sheet pick mechanism 36 (when present in a particular model of the prior art printer 10) are removed and the upper and lower guides 70, 72 which define the return path 68 are modified. In the space formerly occupied by the multi-purpose feeder 30 and the additional pick mechanism 36 is installed a deflector mechanism 76 in accordance with the present invention.

The deflector mechanism 76 is thus disposed in the housing 12 between the lower front opening 16 and the ends of the upper and lower guides 70,72 adjacent to the outlet end 64*b* of the lower exit path 64. The deflector mechanism 76 is operable to divert printed media sheets from the lower exit path 64 to exterior of the housing 12 through the lower front opening 16 therein. Two exemplary embodiments of the deflector mechanism 76 are disclosed herein, the first illustrated in FIG. 4 and the second illustrated in FIG. 5.

As seen in FIG. 4, the first exemplary embodiment of the deflector mechanism 76 includes a diverter body 78 disposed in the housing 12 between the outlet end 64*b* of the lower exit path 64 and the lower front opening 16 in the housing 12. The diverter body 78 has a main portion 80, stationarily disposed at a predetermined angle of slope relative to a horizontal plane, defining a discharge path 82 extending downwardly and outwardly from the outlet end 64*b* of the lower exit path 64 to the lower front opening 16 of the housing 12. Also, the diverter body 78 has an upper edge portion 84 and a lower edge portion 86 attached to and extending in opposite directions from the main portion 80 thereof. The upper and lower edge portions 84, 86 also extend at respective angles to a horizontal plane which are shallower than the angle of slope of the main portion relative to the horizontal plane. The upper edge portion 84 blocks passage of media sheets from the outlet end 64*b* of the lower exit path 64 along the return path 68 to the entrance end 24*a* to the media formation path 24. The lower edge portion 86 projects through the lower front opening 16 in the housing 12 for guiding media sheets from the main portion 80 of the diverter body 78 through the lower front opening 16 in the housing 12 to exterior thereof. By way of example, the diverter body 78 is mounted in a stationary position on the media input tray 14.

As seen in FIG. 5, the second exemplary embodiment of the deflector mechanism 76 includes a diverter body 78 movably disposed in the housing 12, such as pivotally mounted to tray 14 for undergoing movement between first and second orientations, as seen in solid and broken lines. The upper end portion 84 of the diverter body 78 has a wedged-shaped profile and at a corner 84*a* thereof is pivotally mounted to the tray 14. In the first orientation the diverter body 78, its wedge-shaped upper end portion 84 blocks the return path 68 and deflects media sheets along the discharge path 82 extending downwardly and outwardly from the outlet end 64*a* of the lower exit path 64 through the lower front opening 16 to exterior of the housing 12. In the second orientation the diverter body 78, its wedge-shaped upper end portion 84 blocks the discharge path 82 and opens the return path 68 and allows media sheets to move along the return path 68 extending from the outlet end 64*a* of the lower exit path 64 to the entrance end 24*a* of the image formation path 24. The deflector mechanism 76 also includes a prime mover 88 disposed in the housing 12 and drivingly coupled to the diverter body 78. The prime mover 88, such as a solenoid device, a motor or the like, drivingly coupled to the main portion 88 of the diverter body 78 and selectively operable to move the diverter body 78 to change it between the first and second orientations thereof. In such manner, the duplexing capabilities of the printer 10A are preserved since the media sheets can be re-circulated through the printer so that it can be imaged on the reverse side and then upon the media sheet's return by the lower exit path 64 a second time, it can be redirected by the deflector mechanism 76 to outside of the printer 10A and the kiosk cabinet 74. Also, it should be readily understood that any undisclosed additional electronic controls and/or software that may be useful for setting up and operating the printer 10A in the aforementioned manner in conjunction with its use in a kiosk environment is considered well within the purview of one of ordinary skill in the art.

The foregoing description of one or more embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. An image forming device, comprising:

a housing having a collection site on a top portion thereof adapted to receive media sheets and a lower front opening to an exterior of said housing;

an image formation path in said housing extending from an entrance end of said image formation path adjacent a source of supply of media sheets in said housing, past an image forming station in said housing, to an exit end of said image formation path adjacent said collection site;

a lower exit path in said housing extending from an inlet end of said lower exit path adjacent said collection site to an outlet end of said lower exit path adjacent said entrance end of said image formation path and said lower front opening;

a media sheet directing mechanism disposed in said housing between said exit end of said image formation path, said collection site and said inlet end of said lower exit path and selectively operable to deliver printed media sheets to said collection site or said inlet end of said lower exit path; and a deflector mechanism disposed in said housing between said lower front opening and said outlet end of said lower exit path and operable to divert printed media sheets from said lower exit path through said lower front opening to the exterior of said housing.

2. The device of claim 1 wherein said deflector mechanism includes a diverter body disposed in said housing between said outlet end of said lower exit path and said lower front opening in said housing and having a main portion, disposed at a predetermined angle of slope relative to a horizontal plane, defining a discharge path extending downwardly and outwardly from said outlet end of said lower exit path to said lower front opening of said housing.

3. The device of claim 2 wherein said diverter body also has an upper edge portion, extending at an angle to the horizontal plane shallower than the angle of slope of said main portion relative to the horizontal plane, for blocking media sheets from moving along a return path from said outlet end of said lower exit path to said entrance end of said media formation path.

4. The device of claim 3 wherein said diverter body further has a lower edge portion projecting through said lower front opening in said housing, and extending at an angle to the horizontal plane shallower than the angle of slope of said main portion relative to the horizontal plane and in a direction from said main portion opposite that of said upper edge portion, for guiding media sheets from said main portion of said diverter body through said lower front opening in said housing to the exterior of said housing.

5. The device of claim 2 wherein said diverter body is mounted in a stationary position on a media input tray disposed in said housing below said entrance end of said image formation path and adapted to hold a stack of the media sheets so as to provide said source of supply of media sheets.

6. The device of claim 1 wherein said deflector mechanism includes a diverter body movably disposed in said housing for undergoing movement between first and second orientations wherein said first orientation said diverter body deflects media sheets along a discharge path extending downwardly and outwardly from said outlet end of said duplex path through said lower front opening to exterior of said housing and wherein said second orientation said diverter body deflects media sheets to move along a return path extending from said outlet end of said duplex path to said entrance end of said image formation path.

7. The device of claim 6 wherein said deflector mechanism also includes a prime mover disposed in said housing and drivingly coupled to said diverter body and being selectively operable to move said diverter body to change said diverter body between said first and second orientations thereof.

8. The device of claim 7 wherein said prime mover is one of a solenoid device or a motor.

9. An image forming device, comprising:

a housing having a lower front opening and a collection site on a top portion of said housing adapted to receive printed media sheets;

at least one image forming station disposed in said housing;

an image formation path in said housing having an entrance end and an exit end and extending from said entrance end disposed adjacent to but spaced from a source of supply of media sheets, past said at least one image forming station, to said exit end disposed adjacent to but spaced from said collection site on said housing;

a lower exit path in said housing having an inlet end and an outlet end and being spaced from said image formation path and extending from said inlet end disposed adjacent to but spaced from said collection site to said outlet end disposed adjacent to but spaced from said lower front opening of said housing;

a media sheet directing mechanism disposed between said exit end of said image formation path, said top collection site and said inlet end of said lower exit path and selectively operable to deliver printed media sheets to said collection site or to said inlet end of said lower exit path; and a diverter body mounted in a stationary position in said housing between said lower front opening of said housing and said outlet end of said lower exit path having a main portion, disposed at a predetermined angle of slope relative to a horizontal plane, defining a discharge path extending downwardly and outwardly from said outlet end of said lower exit path to said lower front opening of said housing and operable to divert printed media sheets from said lower exit path through said lower front opening to an exterior of said housing.

10. The device of claim 9 wherein said at least one image forming station is a plurality of image forming stations arranged in said housing along said image formation path.

11. The device of claim 9 further comprising a media input tray disposed in said housing spaced below said at least one image forming station and adapted to hold a stack of the media sheets so as to provide said source of supply of media sheets.

12. The device of claim 9 wherein said diverter body also has an upper edge portion, extending at an angle to the horizontal plane shallower than the angle of slope of said main portion relative to the horizontal plane, for blocking media sheets from moving along a return path extending from said outlet end of said lower exit path to said entrance end of said media formation path.

13. The device of claim 12 wherein said diverter body further has a lower edge portion projecting through said lower front opening in said housing, and extending at an angle to the horizontal plane shallower than the angle of slope of said main portion relative to the horizontal plane and in a direction from said main portion opposite that of said upper edge portion, for guiding media sheets from said main portion of said diverter body through said lower front opening in said housing to the exterior of said housing.

14. The device of claim 9 wherein said diverter body is movably disposed in said housing for undergoing movement between first and second orientations wherein said first orientation said diverter body deflects media sheets along a discharge path extending downwardly and outwardly from said outlet end of said duplex path though said lower front opening to exterior of said housing and wherein said second orientation said diverter body deflects media sheets to move along a return path extending from said outlet end of said duplex path to said entrance end of said image formation path.

15. The device of claim 9 wherein said deflector mechanism also includes a prime mover disposed in said housing and drivingly coupled to said diverter body and being selectively operable to move said diverter body to change said diverter body between said first and second orientations thereof, wherein said prime mover is one of a solenoid device or a motor.

16. An image forming device, comprising:

a housing having a lower front opening and a collection site on a top portion of said housing adapted to receive printed media sheets;

a plurality of image forming stations disposed in said housing;

a media input tray in said housing spaced below said image forming stations and adapted to hold a stack of media sheets;

a sheet pick mechanism disposed adjacent to said input tray and operable to move media sheets from said input tray toward an image formation path;

a feed mechanism operable to receive media sheets from said pick mechanism and feed the media sheets along said image formation path through said plurality of image forming stations;

a transport mechanism disposed in said housing alongside said image forming stations and adapted to receive media sheets from said feed mechanism in said image formation path and transport the media sheets through said image forming stations to enable formation of an image thereon;

an internal structure disposed in said housing defining a lower exit path extending from an inlet end thereof disposed adjacent to but spaced from said collection site and an outlet end thereof disposed adjacent to but spaced from said feed mechanism;

a media sheet directing mechanism disposed in said housing between said transport mechanism, said collection site and said inlet end of said lower exit path and selectively operable to deliver printed media sheets to said collection site or said inlet end of said lower exit path; and a deflector mechanism disposed in said housing between said lower front opening of said housing and said outlet end of said lower exit path and operable to divert printed media sheets from said lower exit path through said lower front opening to an exterior of said housing, said deflector mechanism having a diverter body disposed in said housing between said outlet end of said lower exit path and said lower front opening in said housing and being oriented at a predetermined angle of slope, relative to a horizontal plane, defining a discharge path extending downwardly and outwardly from said outlet end of said lower exit path through said lower front opening of said housing.

17. The device of claim 16 wherein said diverter body is mounted in a stationary orientation on said media input tray.

18. The device of claim 16 wherein said diverter body is movably disposed in said housing for undergoing movement between first and second orientations wherein said first orientation said diverter body deflects media sheets along a discharge path extending downwardly and outwardly from said outlet end of said duplex path through said lower front opening to exterior of said housing and wherein said second orientation said diverter body deflects media sheets to move along a return path extending from said outlet end of said duplex path to said feed mechanism.

* * * * *